US011049430B2

(12) United States Patent
Qiu

(10) Patent No.: US 11,049,430 B2
(45) Date of Patent: Jun. 29, 2021

(54) DRIVE METHOD AND DRIVE CIRCUIT OF DISPLAY PANEL

(71) Applicant: HKC CORPORATION LIMITED, Shenzhen (CN)

(72) Inventor: Bin Qiu, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/041,417

(22) PCT Filed: Dec. 14, 2018

(86) PCT No.: PCT/CN2018/121012

§ 371 (c)(1),
(2) Date: Sep. 24, 2020

(87) PCT Pub. No.: WO2020/113653

PCT Pub. Date: Jun. 11, 2020

(65) Prior Publication Data

US 2021/0012696 A1 Jan. 14, 2021

(30) Foreign Application Priority Data

Dec. 3, 2018 (CN) ..... 201811465417.X

(51) Int. Cl.
*G09G 3/20* (2006.01)

(52) U.S. Cl.
CPC ..... *G09G 3/20* (2013.01); *G09G 2310/08* (2013.01); *G09G 2320/0276* (2013.01)

(58) Field of Classification Search
None
See application file for complete search history.

(56) References Cited

U.S. PATENT DOCUMENTS

2008/0165165 A1* 7/2008 Wang ..... G09G 3/3275 345/204
2009/0278866 A1* 11/2009 Kim ..... G09G 3/20 345/690

(Continued)

FOREIGN PATENT DOCUMENTS

CN 102013238 A 4/2011
CN 102469340 A 5/2012

(Continued)

OTHER PUBLICATIONS

Yue Tian, the ISA written comments, dated Sep. 2019, CN.
Yue Tian, the International Search Report, dated Sep. 2019, CN.

*Primary Examiner* — Christopher J Kohlman

(57) ABSTRACT

This application discloses a drive method and drive circuit of a display panel. The drive method includes: dividing the display panel into a plurality of charging areas in advance according to distances from a data driver chip, determining a unique code for each charging area, and pre-storing corresponding information of the charging areas and the digital codes into a timing control chip; detecting a charging area where a pixel to be charged is located, and outputting, by the timing control chip, a corresponding code according to the charging area; and outputting, by the timing control chip, the code to a gamma chip, receiving, by the gamma chip, the code, and outputting a gamma voltage corresponding to the code according to the code to drive charging work of the charging area corresponding to the code.

17 Claims, 3 Drawing Sheets

(56) References Cited

U.S. PATENT DOCUMENTS

| | | | | |
|---|---|---|---|---|
| 2013/0135186 | A1* | 5/2013 | Zhang | G09G 3/3696 345/88 |
| 2014/0092077 | A1 | 4/2014 | Kim et al. | |

FOREIGN PATENT DOCUMENTS

| | | | |
|---|---|---|---|
| CN | 105590609 | A | 5/2016 |
| CN | 106200057 | A | 12/2016 |
| CN | 106297690 | A | 1/2017 |

* cited by examiner

DRIVE METHOD AND DRIVE CIRCUIT OF DISPLAY PANEL

CROSS REFERENCE OF RELATED APPLICATIONS

This application claims the priority to the Chinese Patent Application No. CN201811465417.X, filed with National Intellectual Property Administration, PRC on Dec. 3, 2018 and entitled "DRIVE METHOD AND DRIVE CIRCUIT OF DISPLAY PANEL".

TECHNICAL FIELD

This application relates to the technical field of displaying, and more particularly relates to a drive method and drive circuit of a display panel.

BACKGROUND

The statements herein merely provide the background art related to this application, and do not necessarily constitute the conventional art.

With development and advancement of science and technologies, due to hot spots such as thinness, power saving, and low radiation, liquid crystal displays become mainstream products of displays and are widely applied. Most liquid crystal displays on the market are backlight liquid crystal displays, including a liquid crystal panel and a backlight module. The working principle of the liquid crystal panel is that liquid crystal molecules are placed between two parallel glass substrates, and a drive voltage is applied onto the two glass substrates to control rotating directions of the liquid crystal molecules, so that light in the backlight module is refracted out to generate an image. Due to the performance such as low power consumption, good picture quality, and relatively high production yield, the Thin Film Transistor-Liquid Crystal Display (TFT-LCD) has currently gradually been dominant in the field of display. In addition, the thin film transistor-liquid crystal display includes a liquid crystal panel and a backlight module. The liquid crystal panel includes a Color Filter substrate (CF substrate), a Thin Film Transistor substrate (TFT substrate), and transparent electrodes are provided on relative inner sides of the substrates. A layer of Liquid Crystal (LC) molecules is sandwiched between two substrates.

As liquid crystal display televisions become larger and larger in size, the resolution becomes higher and higher, resulting in a more and more obvious difference in charging of a data line from the near-end and the far-end of a data driver chip when the data line is configured to charge a panel. It is reflected that the far-end is poor in charging effect and relatively low in brightness, and the near-end portion is relatively good in charging effect and relatively high in brightness.

SUMMARY

This application provides a drive method and drive circuit of a display panel, so as to improve a poor display effect of the display panel.

This application provides a drive method of a display panel, including:

dividing the display panel into a plurality of charging areas in advance according to distances from a data driver chip, determining a unique digital code for each charging area, and pre-storing corresponding information of the charging areas and the digital codes into a timing control chip;

detecting a charging area where a pixel to be charged is located, and outputting, by the timing control chip, a corresponding digital code according to the charging area; and outputting, by the timing control chip, the digital code to a gamma chip, receiving, by the gamma chip, the digital code, and outputting a gamma voltage corresponding to the digital code according to the digital code to drive charging work of the charging area corresponding to the digital code.

Optionally, the gamma chip includes a digital-to-analog circuit, and the digital codes are converted into analog signals through the digital-to-analog circuit.

Optionally, after the digital codes are converted into the analog signals through the digital-to-analog circuit, the method includes:

outputting, by the gamma chip, different gamma voltages to drive according to different analog signals.

Optionally, the step of detecting a charging area where a pixel to be charged is located, and outputting, by the timing control chip, a corresponding digital code according to the charging area includes:

counting, by a counter of the timing control chip, the number of rows of data lines.

Optionally, after the step of counting, by a counter of the timing control chip, the number of rows of data lines, the method includes:

identifying, by the timing control chip, a counting value of the counter.

Optionally, after the step of identifying, by the timing control chip, a counting value of the counter, the method includes:

acquiring the corresponding digital code from a memory, and outputting the corresponding digital code.

Optionally, the counting values of the counter include 100, 200, 300, and 400.

Optionally, the counting values of the counter are corresponding to four groups of digital codes of different sizes.

Optionally, the gamma voltage corresponding to each group of digital codes is also increased in sequence.

Optionally, data driver chips are arranged on both the upper and lower side portions of the display panel, and a data line both-side drive mode is adopted.

Optionally, a data driver chip is arranged on only the upper side portion or the lower side portion of the display panel, and a data line single-side drive mode is adopted.

Optionally, the gamma voltage corresponding to the charging area farther from the data driver chip is higher.

Optionally, the gamma chip includes a programmable gamma voltage generation circuit capable of generating at least two different gamma voltages.

Optionally, the gamma chip includes a gamma circuit configured to generate at least two different gamma voltages through resistive subdivision.

Optionally, at least two gamma chips are provided, and each gamma chip generates one gamma voltage; and the size of the gamma voltage generated by each gamma chip is corresponding to the digital code.

Optionally, the gamma chip includes at least two data interfaces.

Optionally, each data interface receives different digital codes, and drives the gamma chip to generate different gamma voltages.

This application further discloses a drive method of a display panel, including:

dividing the display panel into a plurality of charging areas in advance according to distances from a data driver chip, determining a unique digital code for each charging area, and pre-storing corresponding information of the charging areas and the digital codes into a timing control chip;

counting, by a counter of the timing control chip, the number of rows of data lines;

identifying, by the timing control chip, counting values of the counter, acquiring the corresponding digital codes from a memory, and outputting the corresponding digital codes; converting, by a digital-to-analog circuit, the digital codes into analog signals; and outputting, by a gamma chip, different gamma voltages according to different analog signals to drive charging work of the charging areas corresponding to the digital codes, and making the gamma voltage corresponding to the charging area farther from the data driver chip be higher.

This application further discloses a drive circuit of a display panel. The drive circuit as described in the claims includes: a timing control chip, provided with a control circuit, a row counter coupled to the control circuit and a memory; and a gamma chip, provided with a digital-to-analog circuit. The timing control chip acquires corresponding digital codes from the memory and outputs the digital codes according to counting values of the row counter. The gamma chip outputs corresponding gamma voltages according to the received digital codes.

In this solution, firstly the timing control chip detects the digital codes corresponding to the charging areas, and then the gamma chip receives the digital codes, and outputs the different gamma voltages to the charging areas corresponding to the digital codes according to the digital codes. In this way, gamma voltage regulation may be realized according to a charging difference of the charging areas, so as to supply an actual gamma voltage higher than a standard gamma voltage to relatively dark charging areas to enable the corresponding charging areas to be brightened and reduce or even eliminate a brightness difference with other areas.

BRIEF DESCRIPTION OF DRAWINGS

The included accompanying drawings are used for providing further understanding to embodiments of this application, form a part of the specification, are examples of implementations of this application, and describe and explain a principle of this application together with this text. Apparently, the accompanying drawings in the following descriptions are merely some embodiments of this application, and a person of ordinary skill in the art can also obtain other accompanying drawings according to these accompanying drawings without involving any creative effort. In the accompanying drawings.

DETAILED DESCRIPTION OF EMBODIMENTS

Figure 1:
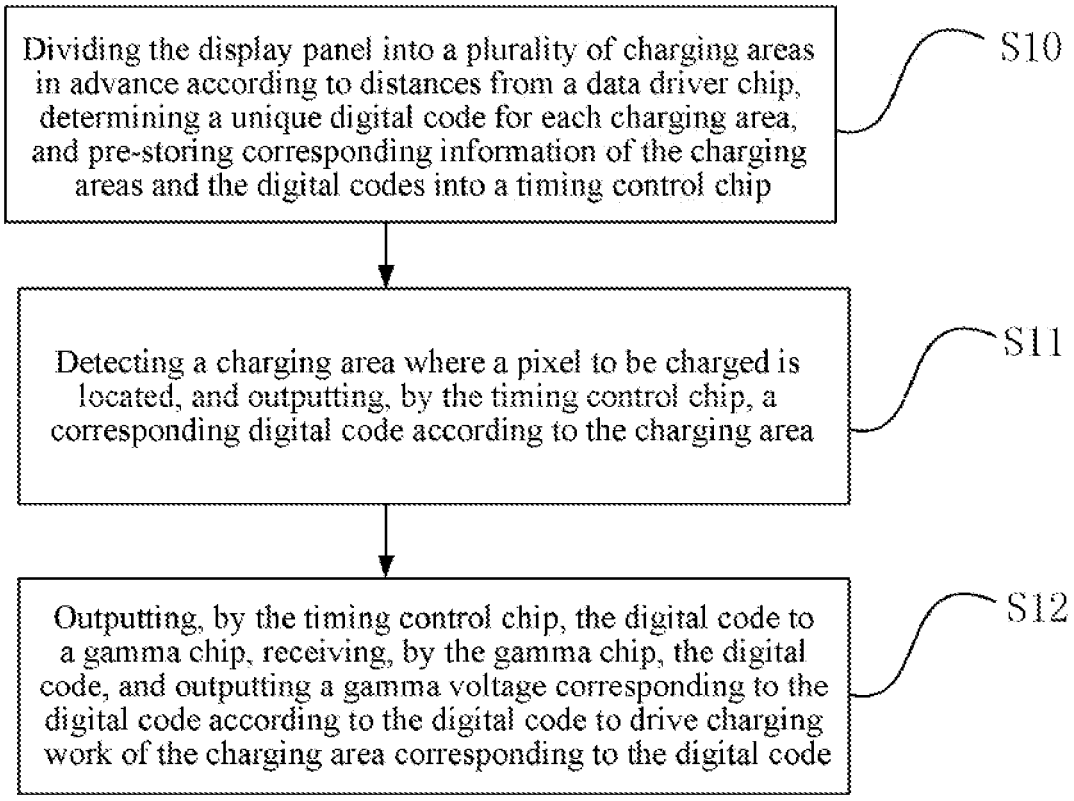
FIG. 1 is a schematic diagram of a flow of a drive method of a display panel according to an embodiment of this application.

Specific structures and functional details disclosed herein are merely representative, and are intended to describe the objectives of the exemplary embodiments of this application. However, this application may be specifically implemented n many alternative forms, and should not be construed as being limited to the embodiments set forth herein.

In the description of this application, it should be understood that orientation or position relationships indicated by the terms such as "center", "transverse", "above", "below", "left", "right", "vertical", "horizontal", "top", "bottom", "inside", and "outside" are based on orientation or position relationships shown in the accompanying drawings, and are used only for ease and brevity of illustration and description, rather than indicating or implying that the mentioned apparatus or component must have a particular orientation or must be constructed and operated in a particular orientation. Therefore, such terms should not be construed as limiting of this application. In addition, the terms such as "first" and "second" are used only for the purpose of description, and should not be understood as indicating or implying the relative importance or implicitly specifying the number of the indicated technical features. Therefore, a feature defined by "first" or "second" can explicitly or implicitly includes one or more of said features. In the description of this application, unless otherwise stated, "a plurality of" means two or more than two. In addition, the terms "include", "comprise" and any variant thereof are intended to cover non-exclusive inclusion.

In the description of this application, it should be noted that unless otherwise explicitly specified or defined, the terms such as "mount", "install", "connect", and "connection" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two components. Persons of ordinary skill in the art may understand the specific meanings of the foregoing terms in this application according to specific situations.

The terms used herein are for the purpose of describing specific embodiments only and is not intended to be limiting of exemplary embodiments. As used herein, the singular forms "a", "an" and "the" are intended to include the plural forms as well, unless the context clearly indicates otherwise. It should be further understood that the terms "include" and/or "comprise" when used in this specification, specify the presence of stated features, integers, steps, operations, elements, and/or components, but do not preclude the presence or addition of one or more other features, integers, steps, operations, elements, components, and/or combinations thereof.

This application is further described below with reference to the accompanying drawings and embodiments.

As shown in FIGS. 1 to 4, the embodiment of this application discloses a drive method of a display panel 80, including the following steps that:

S10: the display panel 80 is divided into a plurality of charging areas 70 in advance according to distances from a data driver chip, a unique digital code is determined for each charging area 70, and corresponding information of the charging areas 70 and the digital codes are pre-stored into a timing control chip 10;

S11: a charging area 70 where a pixel to be charged is located is detected, and the timing control chip 10 outputs a corresponding digital code according to the charging area 70; and S12: the timing control chip 10 outputs the digital code to a gamma chip 20, the gamma chip 20 receives the digital code, and different gamma voltage are output according to the digital code to drive charging work of the charging area 70 corresponding to the digital code.

As liquid crystal display televisions become larger and larger in size, the resolution becomes higher and higher, resulting in a more and more obvious difference in charging of a data line from the near-end and the far-end of a data driver chip when the data line is configured to charge a panel. It is reflected that the far-end is poor in charging effect and relatively low in brightness, and the near-end portion is relatively good in charging effect and relatively high in brightness. In this solution, firstly the timing control chip 10 detects the digital codes corresponding to the charging areas 70, and then the gamma chip 20 receives the digital codes, and outputs the different gamma voltages to the charging areas 70 corresponding to the digital codes according to the digital codes. In this way, gamma voltage regulation may be realized according to a charging difference of the charging areas 70, so as to supply an actual gamma voltage higher than a standard gamma voltage to relatively dark charging areas 70 to enable the corresponding charging areas 70 to be brightened and reduce or even eliminate a brightness difference with other areas.

In one or more embodiments, the gamma chip 20 includes a digital-to-analog circuit 50, and the digital codes are converted into analog signals through the digital-to-analog circuit 50. The gamma chip 20 outputs different gamma voltages to drive according to different analog signals.

In this solution, no memory is arranged in the gamma chip 20, and the risk of rewriting the gamma chip 20 is also avoided, thus ensuring that the gamma chip 20 outputs a correct gamma voltage to the corresponding charging area 70 and ensure that the display panel 80 will not cause a non-uniform display brightness situation due to a non-corresponding gamma voltage. In addition, the gamma chip 20 includes the digital-to-analog circuit 50 so that the digital codes are identified as the analog signals to drive the gamma chip 20 to output different gamma voltages, so as to perform difference-free driving on the various different charging areas 70 of the display panel 80.

In one or more embodiments, the step that a charging area 70 where a pixel to be charged is located is detected, and the timing control chip 10 outputs a corresponding digital code according to the charging area 70 includes that:

a counter of the timing control chip 10 counts the number of rows of data lines; and the timing control chip 10 identifies a counting value of the counter, and acquires the corresponding digital code from a memory, and outputs the corresponding digital code.

In this solution, the timing control chip 10 includes a row counter 30. Since the principle of the row counter 30 is that the count X is added by 1 at each completion of charging of one row; and furthermore, the number of rows of scanning lines is different, and distances of corresponding pixels from the data driver chip are also different, so that the distances of the pixels from the data driver chip are expressed by the number of rows. In this way, control modes in case of different X values may be designed according to requirements. Specifically, for example, the count X may be divided into four stages, namely 100, 200, 300, and 400, and correspondingly, there are four groups of digital codes of different sizes. The gamma voltage corresponding to each group of digital codes is also increased in sequence. A detection and control circuit 60 of the timing control chip 10 identifies the counting values of the raw counter 30, and transmits the corresponding digital codes to the gamma chip 20 according to the count values, and the gamma chip 20 generates the gamma voltages according to the digital codes to charge the charging areas 70 corresponding to the digital codes, thereby realizing a brightness difference of the different charging areas 70. In addition, each group of digital codes may include and be corresponded to a plurality of gamma voltages, so as to perform precise gamma voltage regulation on the charging areas 70 at different distances.

In one or more embodiments, data driver chips are arranged on both the upper and lower side portions of the display panel 80, and a data line both-side drive mode is adopted; or, a data driver chip is arranged on only the upper side portion or the lower side portion of the display panel 80, and a data line single-side drive mode is adopted.

This solution may be applied to a data line single-side drive architecture. In this way, the increase of the technical difficulty caused by the data line both-side drive mode and the difficulty caused by production may be avoided, and the increase of the manufacturing cost and the increase of space occupation are avoided. Furthermore, a data line both-side drive architecture is also available. In the both-side drive architecture, pixels are located at farther positions for data drive on both sides, and there is still a phenomenon of relatively dark brightness. This phenomenon may be avoided by using the method of this application. Furthermore, by the adoption of the data line both-side drive architecture, the quantity, difficulty, etc. of charging area division may be reduced, and the calculating difficulty and requirements for a gamma circuit are reduced. When the data driver chip is arranged on the single side, the gamma voltage at the far-end of the data line is higher. When the data driver chips are arranged on both sides, the gamma voltage of the charging area corresponding to the middle part of the data line is the highest.

In one or more embodiments, the gamma voltage corresponding to the charging area 70 farther from the data driver chip is higher.

Since resistances of the charging areas 70 are increased with the increase of a distance, if the charging areas 70 are farther from the data driver chip, the standard gamma voltage loss generated by the data driver chip is higher, causing that the charging areas 70 that are farther from the data driver chip are darker. An actual gamma voltage with a larger difference than a low standard gamma voltage is applied, so that in this way, the charging areas 70 far from the data driver chip and having a high loss may obtain a larger voltage compensation, and the charging areas 70 close to the data driver chip and having a low loss obtains a smaller voltage compensation. Therefore, the brightness difference among the various charging areas 70 may be well reduced, and even eliminated. Or, if a difference value from the standard gamma voltage is larger, namely the gamma voltage of the charging area closest to the data driver chip is equivalent to the standard gamma voltage, the gamma voltages corresponding to the farther charging areas are higher in order to offset the loss of the gamma voltages, and the increase degree is equivalent to the loss degree.

In one or more embodiments, the gamma chip 20 includes a programmable gamma voltage generation circuit capable of generating at least two different gamma voltages or a gamma circuit configured to generate at least two different gamma voltages through resistive subdivision.

In this solution, either the programmable gamma voltage generation circuit or the gamma circuit configured to generate the gamma voltages through the resistive subdivision may both provide different actual gamma voltages for the different charging areas 70 based on this application, and the application range is wide.

In one or more embodiments, at least two gamma chips 20 are provided, and each gamma chip 20 generates one gamma voltage; and the size of the gamma voltage generated by each gamma chip 20 is corresponding to the digital code.

In this solution, at least two gamma chips 20 are provided, and each chip generates one gamma voltage; and the size of the gamma voltage generated by each module is corresponding to the digital code. In this way, in case of a large data processing volume of the gamma chips 20, the two gamma chips 20 control cooperatively with each other, so that the data volume processed by a single gamma chip 20 is reduced, which is favorable for guaranteeing the stability of the gamma chips 20. Furthermore, the two gamma chips 20 are high in data processing speed, so that different charging areas 70 complete voltage configuration within short time, and an abnormity occurring in a display picture may be avoided.

In one or more embodiments, the gamma chip 20 includes at least two data interfaces. Each data interface receives different digital codes, and drives the gamma chip 20 to generate different gamma voltages.

In this solution, the gamma chip 20 includes at least two data interfaces, and each data interface receives different digital codes, and drives the gamma chip 20 to generate different gamma voltages. In this way, different charging areas 70 may obtain different gamma voltages. The gamma voltage compensation between different charging areas 70 is dynamic, so that the brightness of different charging areas 70 will not have a great difference, and even the brightness difference among different charging areas 70 is eliminated.

Figure 2:
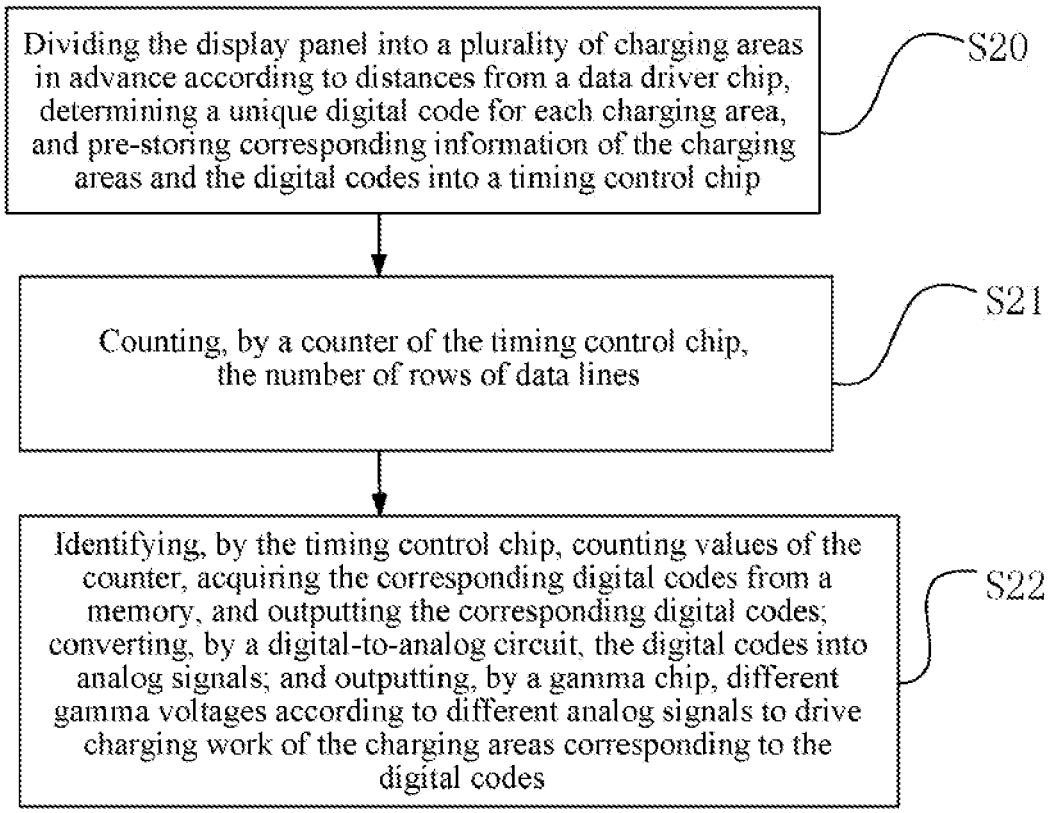
FIG. 2 is a specific schematic diagram of a flow of a drive method of a display panel according to an embodiment of this application.
Figure 3:
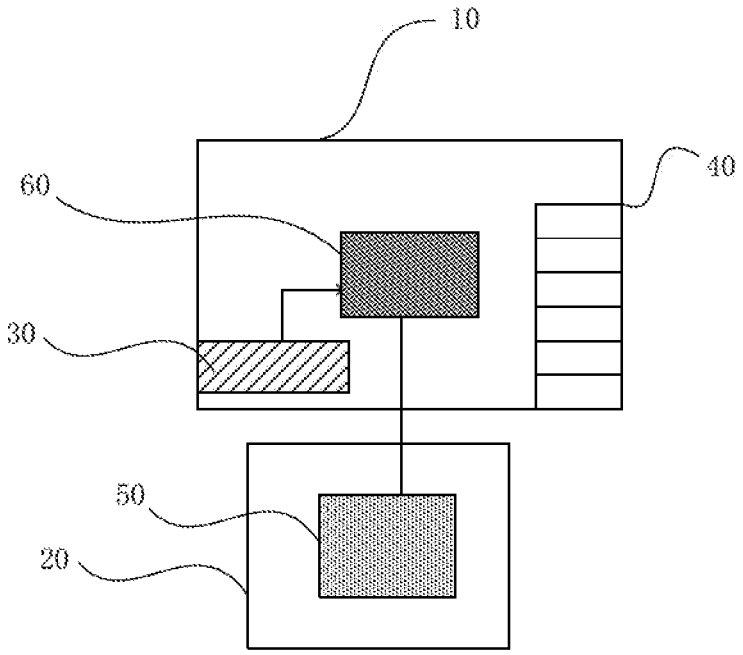
FIG. 3 is a schematic diagram of a display panel component according to an embodiment of this application.
Figure 4:
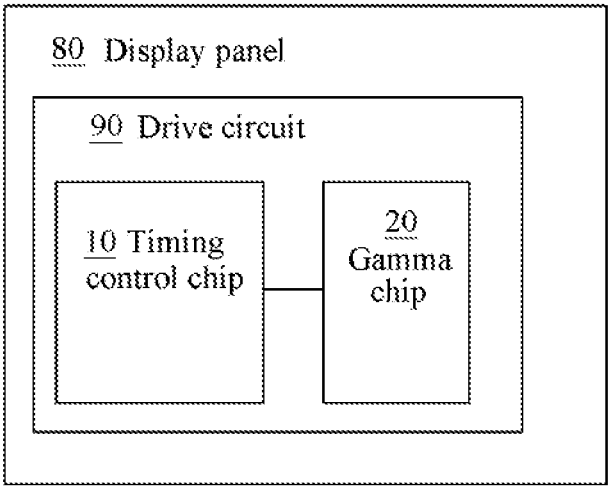
FIG. 4 is a schematic diagram of a drive circuit of a display panel according to an embodiment of this application.

In one or more embodiments, as shown in FIG. 2, a drive method of a display panel 80 is provided, including:

S20: the display panel 80 is divided into a plurality of charging areas 70 in advance according to distances from a data driver chip, a unique digital code is determined for each charging area 70, and corresponding information of the charging areas 70 and the digital codes are pre-stored into a timing control chip 10;

S21: a counter of the timing control chip 10 counts the number of rows of data lines; and S22: the timing control chip 10 identifies counting values of the counter, acquires the corresponding digital codes from a memory, and outputs the corresponding digital codes; a digital-to-analog circuit converts the digital codes into analog signals; a gamma chip outputs different gamma voltages according to different analog signals to drive charging work of the charging areas 70 corresponding to the digital codes.

In one or more embodiments, as shown in FIGS. 1 to 4, a drive circuit of a display panel 80 is provided, including: a timing control chip 10, provided with a control circuit, a row counter 30 coupled to the control circuit and a memory; and a gamma chip 20, provided with a digital-to-analog circuit 50. The timing control chip 10 acquires corresponding digital codes from the memory and outputs the digital codes according to counting values of the row counter 30. The gamma chip 20 outputs corresponding gamma voltages according to the received digital codes.

It should be noted that definitions of all the steps involved in this solution are not considered as limiting the order of the steps on the premise of not affecting the implementation of the specific solution. The steps written in front may be implemented first, later, or even simultaneously. As long as this solution can be implemented, these steps shall be regarded as falling within the protection scope of this application.

The technical solutions of this application can be widely used in various display panels, such as a Twisted Nematic (TN) display panel, an In-Plane Switching (IPS) display panel, a Vertical Alignment (VA) display panel and a Multi-Domain Vertical Alignment (MVA) display panel, and of course, other types of display panels, such as an Organic Light-Emitting Diode (OLED) display panel. The above-mentioned display panels are all suitable for the solutions.

The foregoing contents are detailed descriptions of this application in conjunction with specific optional embodiments, and it should not be considered that the specific implementation of this application is limited to these descriptions. Persons of ordinary skill in the art can further make simple deductions or replacements without departing from the concept of this application, and such deductions or replacements should all be considered as falling within the protection scope of this application.

What is claimed is:

1. A drive method of a display panel, comprising:

dividing the display panel into a plurality of charging areas in advance according to distances from a data driver chip, determining a unique digital code for each charging area, and pre-storing corresponding information of the charging areas and the digital codes into a timing control chip;

detecting a charging area where a pixel to be charged is located, and outputting, by the timing control chip, a corresponding digital code according to the charging area; and receiving, by a gamma chip, the digital code, and outputting a gamma voltage corresponding to the digital code according to the digital code to drive charging work of the charging area corresponding to the digital code, wherein the gamma chip comprises a programmable gamma voltage generation circuit capable of generating at least two different gamma voltages, the gamma chip comprises a gamma circuit configured to generate at least two different gramma voltages through resistive subdivision, the gamma chip comprises at least two data interfaces.

2. The drive method of the display panel according to claim 1, wherein the gamma chip comprises a digital-to-analog circuit; and the digital codes are converted into analog signals through the digital-to-analog circuit.

3. The drive method of the display panel according to claim 2, wherein after the digital codes are converted into the analog signals through the digital-to-analog circuit, the method comprises:

outputting, by the gamma chip, different gamma voltages to drive according to different analog signals.

4. The drive method of the display panel according to claim 1, wherein the step of detecting a charging area where a pixel to be charged is located, and outputting, by the timing control chip, a corresponding digital code according to the charging area comprises:

counting, by a counter of the timing control chip, the number of rows of data lines.

5. The drive method of the display panel according to claim 4, wherein after the step of counting, by a counter of the timing control chip, the number of rows of data lines, the method comprises:

identifying, by the timing control chip, a counting value of the counter.

6. The drive method of the display panel according to claim 4, wherein after the step of identifying, by the timing control chip, a counting value of the counter, the method comprises:

acquiring the corresponding digital code from a memory and outputting the corresponding digital code.

7. The drive method of the display panel according to claim 6, wherein the counting values of the counter comprise 100, 200, 300, and 400.

8. The drive method of the display panel according to claim 7, wherein the counting values of the counter are corresponding to four groups of digital codes of different sizes.

9. The drive method of the display panel according to claim 8, wherein the gamma voltage corresponding to each group of digital codes is also increased in sequence.

10. The drive method of the display panel according to claim 1, wherein data driver chips are arranged on both the upper and lower side portions of the display panel, and a data line both-side drive mode is adopted.

11. The drive method of the display panel according to claim 10, wherein a data driver chip is arranged on only the upper side portion or the lower side portion of the display panel, and a data line single-side drive mode is adopted.

12. The drive method of the display panel according to claim 1, wherein the gamma voltage corresponding to the charging area farther from the data driver chip is higher.

13. The drive method of the display panel according to claim 1, wherein at least two gamma chips are provided, and each gamma chip generates one gamma voltage.

14. The drive method of the display panel according to claim 13, wherein the size of the gamma voltage generated by each gamma chip is corresponding to the digital code.

15. The drive method of the display panel according to claim 1, wherein each data interface receives different digital codes, and drives the gamma chip to generate different gamma voltages.

16. A drive method of a display panel, comprising:

dividing the display panel into a plurality of charging areas in advance according to distances from a data driver chip, determining a unique digital code for each charging area, and pre-storing corresponding information of the charging areas and the digital codes into a timing control chip;

counting, by a counter of the timing control chip, the member of rows of data lines; and identifying, by the timing control chip, counting values of the counter, acquiring the corresponding digital codes from a memory, and outputting the corresponding digital codes; converting, by a digital-to-analog circuit, the digital codes into analog signals; and outputting, by a gamma chip, different gamma voltages according to different analog signals to drive charging work of the charging areas corresponding to the digital codes; and making the gamma voltage corresponding to the charging area farther from the data driver chip be higher, wherein the gamma chip comprises a programmable gamma voltage generation circuit capable of generating at least two different gamma voltages, the gamma chip comprises a gamma circuit configured to generate at least two different gamma voltages through resistive subdivision, the gamma chip comprises at least two data interfaces.

17. A drive circuit of a display panel, comprising:

a timing control chip, provided with a control circuit, a row counter coupled to the control circuit and a memory; and a gamma chip, provided with a digital-to-analog circuit, wherein the timing control chip acquires corresponding digital codes from the memory and outputs the digital codes according to counting values of the row counter; and the gamma chip outputs corresponding gamma voltages according to the received digital codes, wherein the gamma chip comprises a programmable gamma voltage generation circuit capable of generating at least two different gamma voltages, the gamma chip comprises a gamma circuit configured to generate at least two different gamma voltages through resistive subdivision, the gamma chip comprises at least two data interfaces.

* * * * *